US005983570A

United States Patent [19]

Brown

[11] Patent Number: 5,983,570

[45] Date of Patent: Nov. 16, 1999

[54] SAFETY DEVICE FOR SLIDING GLASS DOORS

[76] Inventor: Charles T. Brown, 218 Las Palmas St., Royal Palm Beach, Fla. 33411

[21] Appl. No.: 08/901,436

[22] Filed: Jul. 28, 1997

[51] Int. Cl.[6] ..... E06B 7/16

[52] U.S. Cl. ..... 49/475.1; 49/26; 49/462; 52/207

[58] Field of Search ..... 49/414, 428, 472–475, 49/449; 52/207, 204.51

[56] References Cited

U.S. PATENT DOCUMENTS 3,427,776 2/1969 Lake et al. ..... 49/475.1 X
4,208,841 6/1980 Starks ..... 49/449
4,532,743 8/1985 Miller et al. ..... 49/449 X

*Primary Examiner*—Daniel P. Stodola
*Assistant Examiner*—Hugh B. Thompson
*Attorney, Agent, or Firm*—McHale & Slavin

[57] ABSTRACT

A safety device for sliding glass doors to prevent complete closure thereby inhibiting injury to small children. The safety device consists of a foam rubber strip which is secured to the leading edge of the sliding glass door by the use of a hook & pile attachment. The foam rubber prevents airborne debris from entering the residence while in a closed position as well as preventing conditioned air from escaping the residence. A lock mechanism provides security to the door while in a closed position. The safety device may be detached with provisions for placement of the device on a trailing edge of the sliding glass door for storage.

7 Claims, 2 Drawing Sheets

SAFETY DEVICE FOR SLIDING GLASS DOORS

FIELD OF THE INVENTION

This invention is related to safety devices for sliding glass doors, and in particular to a removable safety guard that secures to the edge of a sliding glass door to prevent injury to fingers.

BACKGROUND OF THE INVENTION

Sliding glass doors are modern conveniences found in most homes. The sliding glass door allows for the entrance and exiting through a door that moves on rollers in a parallel plane, versus a door that moves on hinges and rotates through an arc. A sliding glass door can be made from solid plate glass as it is supported by and moves along a predefined track. For this reason, sliding glass doors typically consist of a large pane of glass allowing the occupants to view outside the home in an unobstructed manner. Sliding glass doors provide a convenience in that they can be easier to open and close then a regular door. For example, children can easily push a sliding glass door open or closed if the sliding glass door is left in a unlocked position. However, small children typically are unable to rotate a door handle in order to allow the same type of entrance and exit.

Despite the conveniences of a sliding glass door, the ease of opening and closing can also pose a safety problem. In particular, throughout my years as a firemen I have come across numerous instances where childrens fingers have been severely damaged or severed due to the closing of a sliding glass door. The child typically grasps the end of the sliding glass door to try to pull it closed. Once the door is placed in motion it maintains momentum which can injure the child if the door traps the child's fingers between the leading edge and the closing hasp. The child's hands, being of small appendages, are no match to the amount of weight presented by the door. Depending upon the size of the door, a weight of over one hundred pounds is possible. The heavier door weights appear negligible in view of roller technology, however, the increased rolling efficiency makes the heavier doors even more dangerous. In addition, a typical door assembly includes a channel projection to prevent unauthorized access to the latching mechanism. The projections extend on each side of the door and are designed to a close tolerance to the door. These projections act like a knife should a child's fingers be caught between the moving door and either projection.

One known safety device lessens the ease of moving sliding glass doors. The decreased movement prevents a small child from slamming a door closed but also makes it difficult for the elderly to operate the door. If the sliding glass door is difficult to move, during an emergency the exit is effectively blocked. For this reason, the sliding glass door is typically left in either an open or closed position. An open door will allow the conditioned air to escape thereby causing high electrical or fuel bills. Further, airborne debris and insects may be allowed to enter the home.

What is lacking in the art is a device that permits the normal operation of a sliding glass door yet provides a barrier and prevents injury to a child's fingers.

SUMMARY OF THE INVENTION

The instant invention is a foam rubber strip having a particular compression that releasably secures to the leading edge of a sliding glass door. The foam rubber strip allows for a partial closing of the sliding glass door with approximately a three inch space being maintained between the leading edge and the door bulkhead. The device is attached to the leading edge of a door by a hook and pile attachment. The strip provides a seal to the external elements preventing conditioned air from escaping and airborne debris from entering.

Should a child close a sliding glass door with the strip attached, placing fingers between the leading edge, the foam rubber and the sliding glass door bulkhead will cause a deformation of the foam rubber. Thus, the foam rubber will deflect where the children's fingers are positioned while the remaining foam rubber will accept the pressure of the sliding glass door to be closed so as to prevent a complete closure.

The foam rubber is weather resistant and color-coated to match the door. The hook and pile attachment, commonly known under the trademark Velcro, allows for ease of attachment and removal. The felt portion of the hook & pile material is placed upon the leading edge of the door which further provides an insulating seal when the strip is not installed. A second strip of the felt material is placed on the trailing edge of the sliding glass door for securement of the foam rubber in a storage position when not in use.

Thus an object of the instant invention is to teach a low cost simplistic protection device that inhibits injuring of a child's fingers when a sliding glass door is closing.

Yet another object of the instant invention is to disclose a child's safety device for sliding glass doors that further inhibits rain, airborne debris, as well as conditioned air from escaping or entering of the home.

Still another objective of the instant invention is to teach a device that can be easily installed or removed and is stored in an easily accessible location.

Another object of the instant invention is to teach the use of a sealing device that is color coated to match the molding of a sliding glass door and provide aesthetically pleasing design.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although this invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
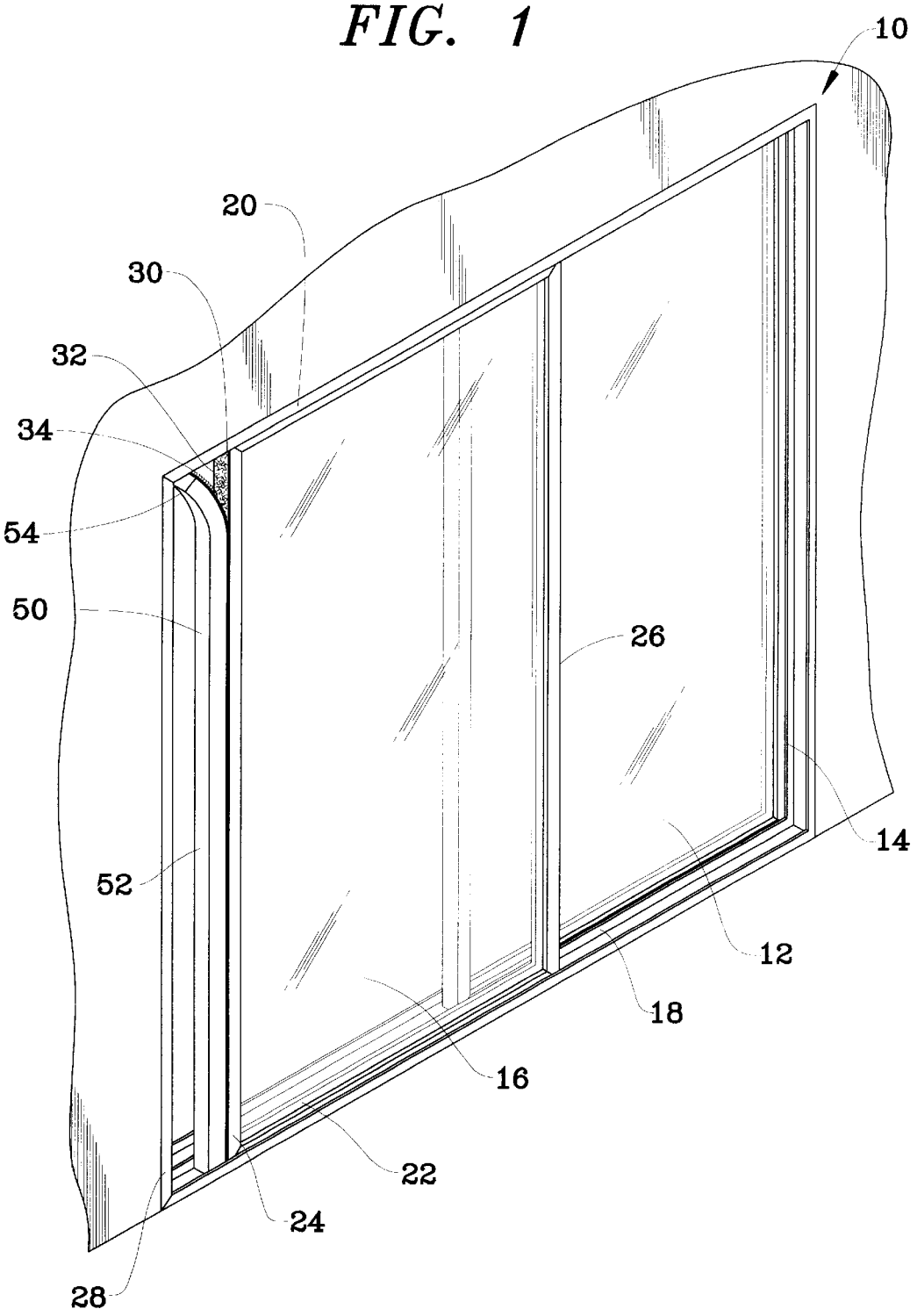
FIG. 1 is a pictorial view of a sliding glass door having the safety device installed.

Now referring to FIG. 1 set forth is a pictorial view of a sliding glass door assembly 10. The assembly includes a fixed door pane 12 which is sealed and secured to a bulk head 14. A second door pane 16 is slidable along a preformed track 18. The second door pane 16 is further defined by an upper edge 20, a lower edge 22, leading edge 24 and trailing edge 26. The leading edge 24 is used to abut the side surface of the door jam 28 and has a substantially flat front surface 30 receptive to the positioning of the felt portion 32 of a hook & pile attachment. The felt portion 32 is adhesively attached to the leading edge 24 providing a weather seal when the door pane 16 is placed into a closed position and no safety device attached.

When the second door pane 16 is placed in an open position, the leading edge 24 is exposed and readily accessible for placement of a foam rubber substantially rectangular shaped material strip 50 which operates as a safety cushion. The foam rubber is approximately two inches wide and cut to fit the leading edge of the door which has a length extending from the top edge to the bottom edge. The hook 34 component of the hook & pile securement material is adhesively or permanently secured to the rear surface of the foam rubber strip 50. In this manner, a consumer can readily attach the foam rubber strip 50 to the leading side edge 24 of the door 24 forming an extension to the door. The foam rubber strip 50 moves in relation to the movement of door pane 16 wherein complete closure of the door is interrupted by the width of the foam.

In operation, during the closing of the door pane 16, should a child's fingers be placed between the front 52 of the foam rubber strip 50 and the door jam 28, the foam rubber will deform to avoid damaging the child's fingers. The foam rubber operates to deform around the fingers while the remaining portion of the foam will absorb the closing pressure exhibited by the door pane 16. For this reason, a soft foam rubber is the preferred embodiment as the length and width of the rubber operate to distribute the closing force on an equal basis.

The foam rubber furthers acts as an insulation device so as to prevent air from entering or escaping the home while in the closed position. The foam rubber preferably includes a vinyl or the like water impervious covering. In addition, the covering can be colored so as to match the color of the sliding glass door assembly.

Figure 3:
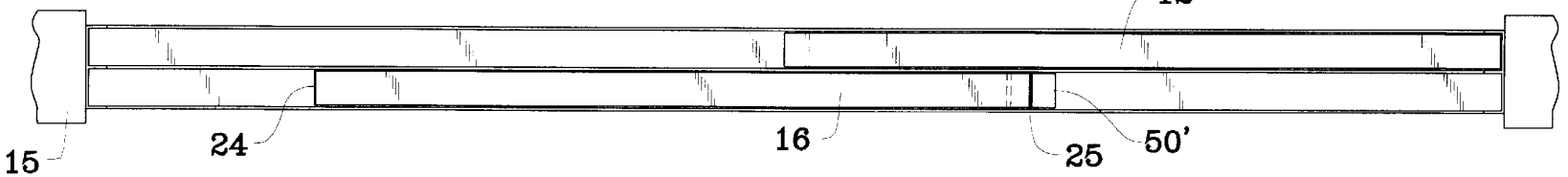
FIG. 3 is a cross-sectional top view of a sliding glass door in an open position with the safety device placed in a stored position.

As shown by way of illustration, the foam rubber strip 50 may be easily removed from the door pane 16 by pulling edge 54 so as to cause a peeling effect in disengagement of the hook & pile attachment. As shown in FIG. 3, described later in this specification, the foam rubber strip 50 can be attached to the trailing edge of the door pane for purposes of storage.

Figure 2:
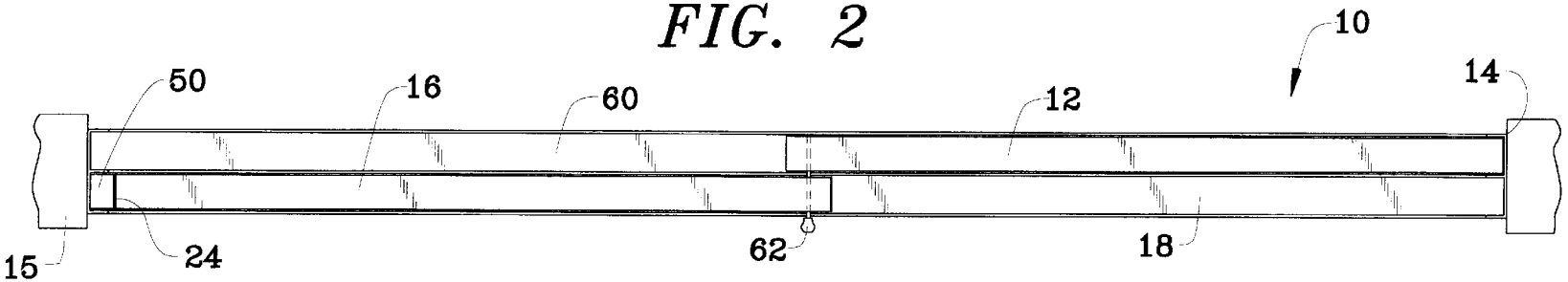
FIG. 2 is a cross-sectional top view of a sliding glass door in a closed position with the safety device installed.

Now referring to FIG. 2, depicted is a top cross-sectional view of the sliding glass door assembly with door pane 12 shown in a fixed position against bulk head 14 and the second door pane 16 shown in a closed position with foam rubber strip 50 attached to leading edge 24. The foam rubber strip provides a seal for closing the distance between the leading edge 24 and bulk head 15. The seal operates to prevent airborne debris from entering the home as well as conditioned air from exiting the home. Door panes 12 and 16 may be further secured to each other in a locked position by placement of locking pin 62 between the panes. The locking pin will prevent sliding glass door pane 16 from movement along track 18 as well as prevent door pane 12 from moving along track 60, if door pane 12 is moveable.

FIG. 3 is a cross sectional top view illustrating sliding glass door pane 16 in a partially opened position. Foam rubber 50' is secured to trailing edge 25 depicting the storage position. The storage position allows for the closing of the sliding glass door pane 16 against bulk head 15, in the designed manner. The storage position allows full closure of the door at night or when the home is vacant.

Figure 4:
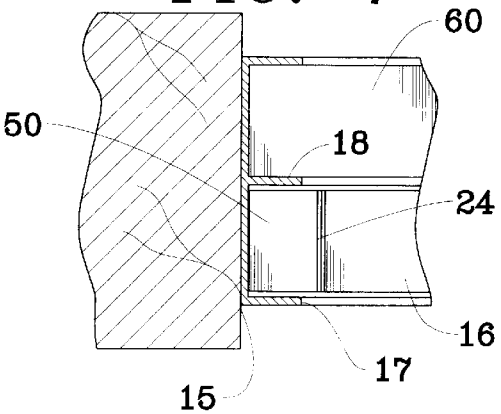
FIG. 4 is an enlarged partial view of a sliding glass door bulkhead.

Now referring to FIG. 4, an enlarged cross sectional view of the door pane 16 is shown in a closed position against bulkhead 15. Security projections 17 and 19, which form a U-shaped channel extend outward from the bulkhead and are used to prevent access to the latching mechanism. The leading edge 24 of the sliding glass door pane 16, and the projections, can cause a scissoring effect that may injure the fingers. The foam strip 50 maintains a spacial distance from the projections 17 and 18 to prevent injury to the child's fingers. The width of the foam is preferably between two and three inches, although various foam densities allow for an increase or decrease in width.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A safety device in combination with a sliding glass door, said device being positionable between a use position and a storage position, said sliding glass door having a leading edge and an opposite trailing edge, said sliding glass door being slidably mounted within a frame assembly having a U-sectioned channel adapted to engage said door leading edge, said safety device preventing said sliding glass door leading edge from entering said U-sectioned channel when positioned in said use position, said safety device comprising:

a stopping structure constructed from a strip of flexible foam rubber having a length essentially equal to the length of said leading edge and said trailing edge, said stopping structure having a width essentially equal to a width of said leading edge and said trailing edge and a depth essentially equal to a depth of said U-sectioned channel, said stopping structure having a door-facing attachment surface and said stopping structure having an impact surface opposite said attachment surface;

first portions of hook and loop fastening material disposed on said sliding glass door leading edge and said sliding glass door trailing edge, respectively;

a second portion of hook and loop fastening material disposed on said stopping structure attachment surface, said second portion of hook and loop fastening material being adapted to releasably engage one of said first portions of hook and loop material for alternate securement of said stopping structure in said use position along said length of said sliding glass door leading edge and in said storage position along said length of said sliding glass door trailing edge;

whereby said stopping structure is alternately secured to said leading edge and said trailing edge and whereby when said stopping structure is in said use position, said stopping structure prevents said sliding glass door leading edge from entering said U-sectioned channel, and whereby said stopping structure deforms to inhibit injury to fingers caught between said impact surface and said U-sectioned.

2. The safety device according to claim 1 wherein said stopping structure is colored.

3. The safety device according to claim 1 wherein said stopping structure includes a vinyl coating.

4. The safety device according to claim 1 wherein said depth is approximately 2.5 inches.

5. The safety device according to claim 1 including a means for locking said sliding door in a fixed position when said stopping structure is mounted to said leading edge.

6. A safety device in combination with a sliding glass door, said device being positionable between a use position and a storage position, said sliding glass door having a leading edge and an opposite trailing edge, said sliding glass door being slidably mounted within a frame assembly having a U-sectioned channel adapted to engage said door leading edge, said safety device preventing said sliding glass door leading edge from entering said U-sectioned channel when positioned in said use position, said safety device comprising:

a stopping structure constructed from a color coated strip of flexible foam rubber having a length essentially equal to the length of said leading edge and said trailing edge, a width essentially equal to a width of said leading edge and said trailing edge, and a depth of about 2.5 inches, said stopping structure having a door-facing attachment surface and said stopping structure having an impact surface opposite said attachment surface;

first portions of hook and loop fastening material disposed on said sliding lass door leading edge and said sliding glass door trailing edge, respectively;

a second portion of hook and loop fastening material disposed on said stopping structure attachment surface, said second portion of hook and loop fastening material being adapted to releasably engage one of said first portions of hook and loop material for alternate securement of said stopping structure in said use position along said length of said sliding glass door leading edge and in said storage position alone said length of said sliding glass door trailing edge;

whereby said stopping structure is alternately secured along said sliding glass door leading edge in said use position and along said sliding glass door trailing edge in said storage position, and whereby when said stopping structure is in said use position, said stopping structure deforms to inhibit injury to fingers caught between said U-sectioned channel and said impact surface.

7. The safety device according to claim 6 including a means for locking said sliding glass door in a fixed position when said stopping structure is installed.

* * * * *